US005708983A

United States Patent [19]

Cross et al.

[11] Patent Number: 5,708,983

[45] Date of Patent: Jan. 20, 1998

[54] INFLATABLE CHEESE WEDGE HAT

[75] Inventors: David R. Cross, Fox Point; Keith M. Baxter, Brookfield; Thomas L. Maser, Mequon Court, all of Wis.

[73] Assignee: Blowhard Industries Inc., Mequon, Wis.

[21] Appl. No.: 827,073

[22] Filed: Mar. 26, 1997

[51] Int. Cl.[6] ..... A42B 1/00

[52] U.S. Cl. ..... 2/171; 2/200.2; 2/DIG. 10

[58] Field of Search ..... 2/171, DIG. 10, 2/181, 182.1, 200.1, 200.2

[56] References Cited

U.S. PATENT DOCUMENTS 1,171,204 2/1916 Jacobs ..... 2/181

*Primary Examiner*—Diana Biefeld

*Attorney, Agent, or Firm*—Quarles & Brady

[57] ABSTRACT

An inflatable hat provides a concave pocket constructed of flexible material that opens to freely receive the user's head in the manner of a conventional hat by virtue of supports resisting the outward extension of the pocket when the hat is inflated. In one embodiment, the pocket is a cylindrical tube extending between parallel walls of the hat structure. A bowing in of the tube provides varying sizes of hat openings depending on the amount of inflation to provide a comfortable fit to different users.

3 Claims, 3 Drawing Sheets

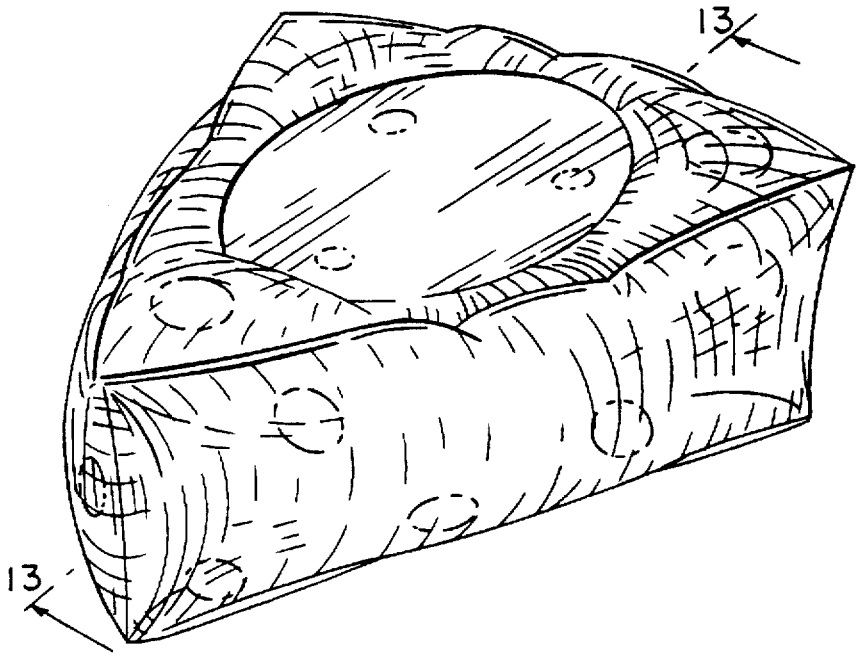
FIG. 7
FIG. 8
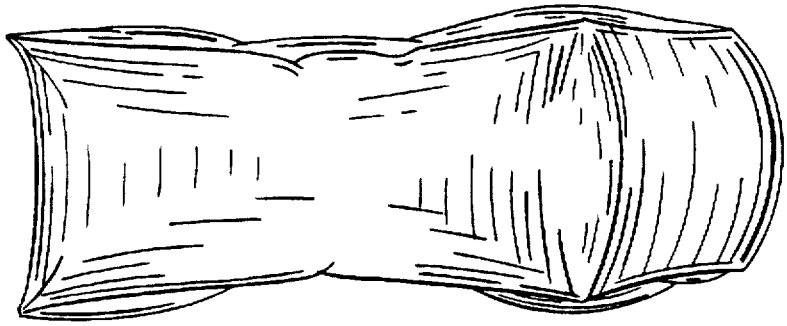
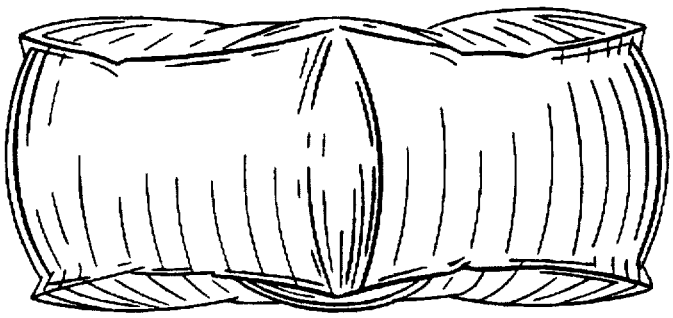
FIG. 9

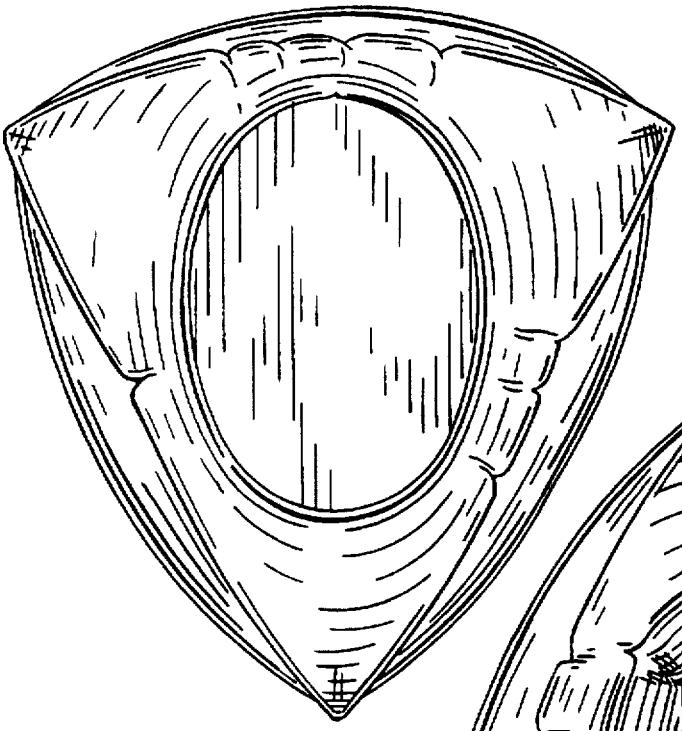
FIG. 10
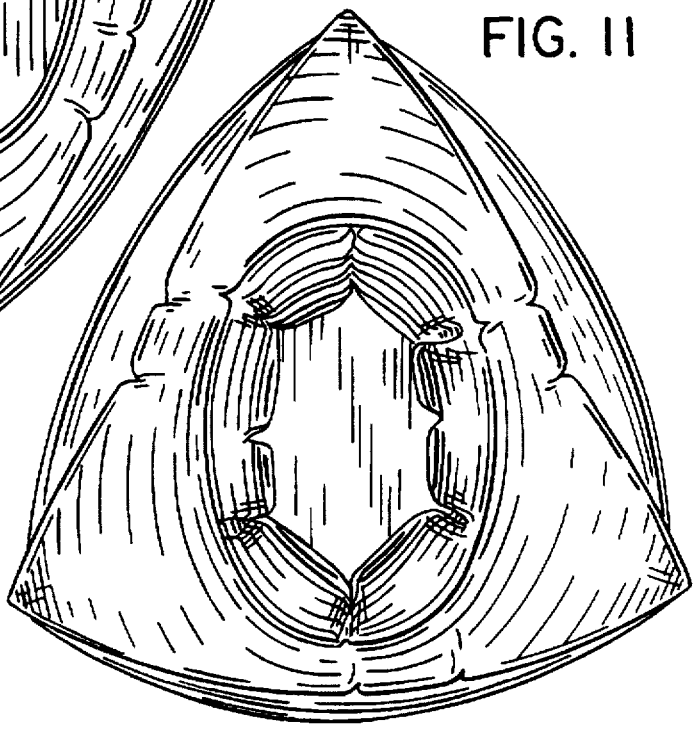
FIG. 11
FIG. 12
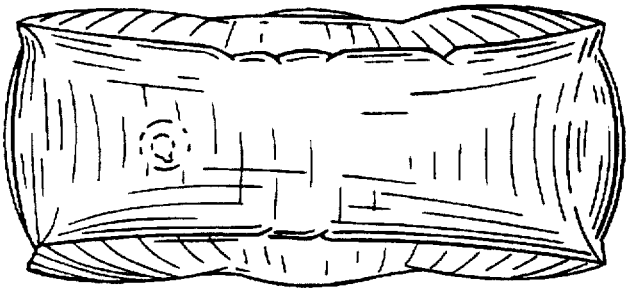
FIG. 13
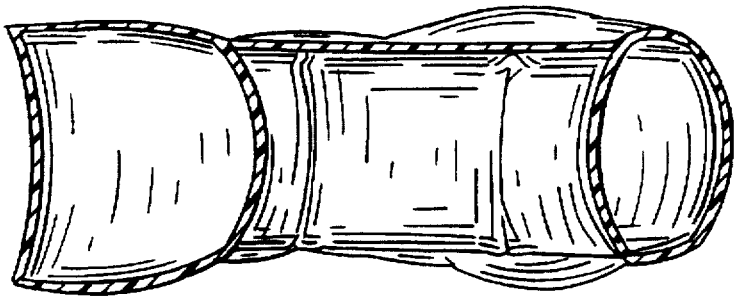

INFLATABLE CHEESE WEDGE HAT

CROSS-REFERENCE TO RELATED APPLICATIONS

This application claims the benefit of U.S. Provisional application Ser. No. 60/036,557 filed on Jan. 29, 1997 and hereby incorporated by reference.

STATEMENT REGARDING FEDERALLY SPONSORED RESEARCH OR DEVELOPMENT

BACKGROUND OF THE INVENTION

The present invention relates to hats and in particular to an inflatable hat shaped liked a wedge of cheese.

A popular way of showing support for a sports team is the wearing of an oversized hat depicting a symbol or theme of the sports team or its supporters. Large foam cowboy hats and foam cheese wedges are two examples. In order to obtain the desired large size and bright colors, it is typical to construct head pieces from lightweight plastic foam.

A significant problem with such foam constructions is that they are intrinsically bulky and accordingly expensive to ship and store at retail sites. This former problem in shipping particularly affects fans who wish to travel to ether cities to view their team and must transport the bulky head pieces.

Normally the foam hats have hemispherical depressions in their lower surface which may fit over the user's head. For reasons of manufacturing economy, only one size of head hole is used, making the hat tighter for some users than others. The insulating properties of the foam and its close fit can make such headwear hot and uncomfortable. The foam surface is difficult to paint or print making logos and sponsorship information impractical.

BRIEF SUMMARY OF THE INVENTION

The present invention provides an inflatable hat having an integral aperture for receiving a wearer's head and an arbitrary and fanciful outer surface. With respect to a preferred embodiment of a wedge of cheese, the inflated material provides a pleasant pillow-like visage. A central cylinder permits the production of a socket within the inflated structure for receiving the user's head but provides a ventilation gap above the user's head improving wearer comfort. The entire structure may deflate and fold for easy transportation and storage. The outer surface may be painted and may include a printed commercial logo.

Specifically, the present invention provides an inflatable hat constructed of a bag of flexible material enclosing a volume and having an aperture sized to receive the crown of an average human head. A pocket of flexible material is attached at its periphery to an inner edge of the aperture and extends into the volume. Supports hold the pocket extending into the volume when the volume is inflated.

Thus it is one object of the invention to provide an inflatable hat that may be inflated with substantial pressure as is necessary to produce an arbitrary inflated shape and yet which offers ample and comfortable room for the user's head. The supports allow a concave pocket of arbitrary size to be produced in the hat.

The bag may include a first flexible plastic sheet having the aperture, a second flexible plastic sheet opposite the first flexible plastic sheet, and upstanding side walls attached at lower and upper edges to the peripheries of the first and second flexible plastic sheets. A pocket may be a tube of flexible material and the supports may be an upper edge of the tube joined to the inner surface of the second plastic sheet.

Thus it is another object of the invention to provide a simple yet flexible support structure for holding the pocket receiving the user's head in concave configuration after inflation of the hat. By extending the pocket all the way through the hat to the opposing wall of the bag, the forces of inflation hold the pocket in its concave configuration yet allow it to be easily deflated and folded.

The second flexible plastic sheet may include at least one vent hole circumscribed by the upper edge of the tube.

Thus it is another object of the invention to provide an inflatable hat that provides good ventilation for the user's head.

The foregoing and other objects and advantages of the invention will appear from the following description. In this description, reference is made to the accompanying drawings which form a part hereof and in which there is shown by way of illustration, a preferred embodiment of the invention. Such embodiment does not necessary represent the full scope of the invention, however, and reference must be made therefore to the claims for interpreting the scope of the invention.

BRIEF DESCRIPTION OF THE SEVERAL VIEWS OF THE DRAWINGS

FIG. 7 is a perspective shaded version of the hat of FIG. 1 showing surface ornamentation in phantom such as may be printed on the material of the hat;

FIG. 8 is a right side elevational view of the hat of FIG. 7;

FIG. 9 is a front elevational view of the hat of FIG. 7.

FIG. 10 is a top plan view of the hat of FIG. 7 looking downward;

FIG. 11 is a bottom plan view of the hat of FIG. 7 looking up;

FIG. 12 is a rear elevation view of the hat of FIG. 7; and

FIG. 13 is a cross sectional view of the hat of FIG. 7 taken along line 13—13 in FIG. 7.

DETAILED DESCRIPTION OF THE INVENTION

Figure 1:
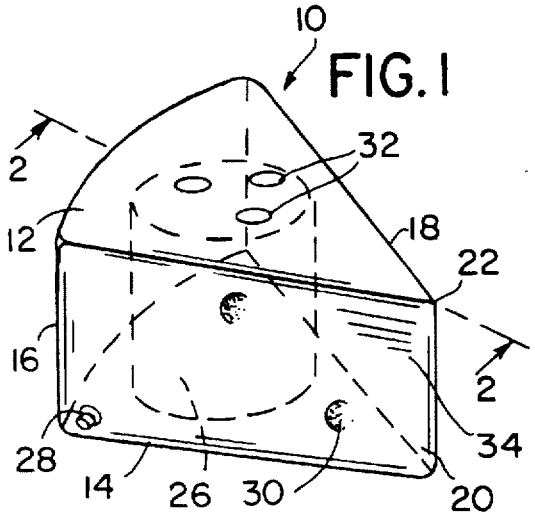
FIG. 1 is a perspective view of the hat of the present invention showing in phantom a center cylinder forming a chamber into which the crown of the user's head may be inserted.
Figure 2:
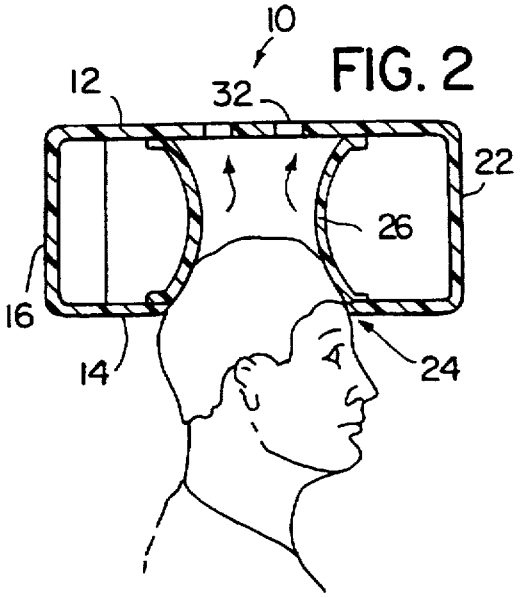
FIG. 2 is a cross-section along line 2—2 of FIG. 1 showing the placement of the cylinder and apertures in the cylinder's upper base for ventilation.

Referring to FIG. 1, a cheese wedge hat 10 has an outer form approximating a pie-shaped wedge from a solid cylinder and thus has upper and lower sheets 12 and 14 that are sectors of circles, an outer arcuate sheet 16 conforming to the periphery of the solid cylinder and left and right angle sheets 18 and 20 of generally rectangular dimension leading to a vertex line 22 to complete the pie shape.

Each of these sheets 14 through 20 are cut from vinyl sheets and thermally welded to each other at their intersections according to methods well understood in the art. The sheets may be assembled with the unit turned inside out so that the seams between sheets are held within the internal volume defined by the hat 10.

The bottom sheet 14 of the hat has a circular aperture 24 sized to receive the crown of a standard human head. Attached to the edge of the aperture 24 is a cylinder 26 also formed of vinyl and welded at its lower edge to the edge of the aperture 24. The upper edge of the cylinder 26 extends just to the upper sheet 12 and is welded there in an air tight manner. Accordingly, the cylinder is closed at the top by sheet 12 and open at the bottom for receipt of a user's head. The vinyl used for the cylinder 26 may be textured so as to provide a more breathable surface to be in contact with the user's head and to provide greater grip to keep the hat from slipping off. Air may be introduced through a nozzle 28 in sheet 20 into the space held within the sheets 12 through 20 but outside of the cylinder 26. The cylinder 26 serves to preserve the dimensional stability of the hat 10 in a vertical direction and may be welded at tangent points to sheets 14 and 18 to provide a lessening of outward bowing of the hat 10 in those dimensions as well. Otherwise, there is a gentle bowing of the entire shape providing a pleasing and unthreatening esthetic aspect. Referring again to FIG. 1, the outer surface of sheets 12 through 20 may be painted an orangish-yellow color reminiscent of cheese, and dimples 30 may be painted on its surface to provide the visual impression of holes such as are found in Swiss cheese and the like. Ventilation for the user's head may be promoted by the addition of apertures 32 at the upper base of the cylinder formed by cylinder 26 which provide for the flow of air but are sized to be similar in shape and appearance to the shaded dimples 30. A logo 34 may likewise be printed on the sheet 14 or 18 or other sheets allowing for sponsorship or other promotional material to be added.

Figure 3:
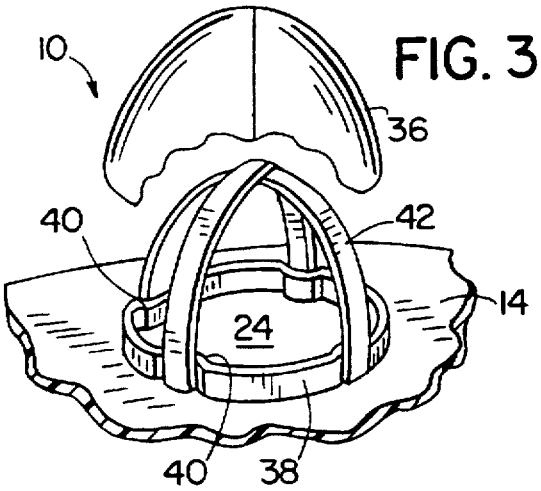
FIG. 3 is an alternative embodiment of the hat of FIG. 1 wherein the cylinder is replaced by a hemispherical pocket supported by crossed battens.

Referring now to FIG. 3 in an alternative embodiment, the center cylinder 26 may be replaced with a hemispherical pocket 36 welded to the lower sheet 14 according to methods known in the art to bow into the volume of the hat 10. At the point of the weld, a single strip of material 38 is attached at one edge and at various points along the inner surface of the hemispherical pocket 36 to form an equatorial band providing four receiving sleeves 40 opening upward into the hemispherical pocket 36 and equally spaced around the opening through which the user's head is inserted. Flexible battens 42 formed into crossing arches may have their ends inserted into the sleeves 40 to form the framework for support that holds the hemispherical pocket 36 in concave configuration within the volume of the hat 10 despite countervailing forces of air pressure. The battens 42 may be removed by a deformation of the material of the hat 10 when the hat 10 is deflated so that the hat 10 may be folded flat for storage.

Figure 4:
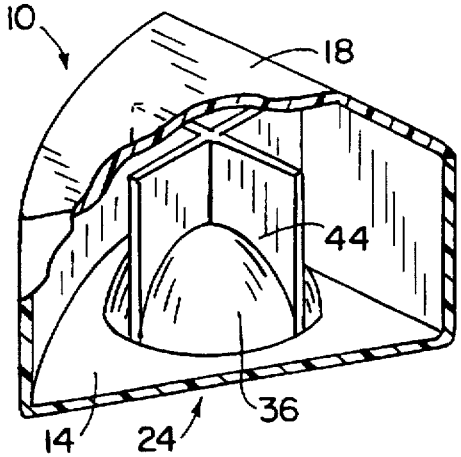
FIG. 4 is an alternative embodiment of the hat of FIG. 1 in which the hemispherical pocket for the user's head is supported by internal spanning gussets.

Referring now to FIG. 4, in yet a further alternative embodiment, the hemispherical pocket 36 welded to sheet 14 about the aperture 24 is supported not by battens 42 from the lower side but by spanning gussets 44 attached at one edge to the upper, inner side of the hemispherical pocket 36 and at the other edge to the lower, inner surface of sheet 18. When the hat 10 is inflated, the gussets 44 act in tension preventing an outward bowing of the hemispherical pocket 36.

Figure 5:
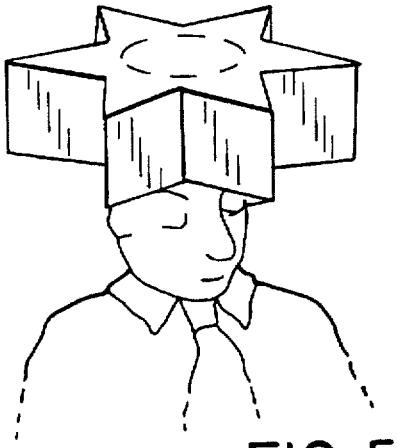
FIG. 5 is a perspective view of an alternative embodiment of the hats of FIGS. 1–4 in the shape of a hockey puck.

Referring now to FIG. 5, it will be understood that this general approach may be used to generate a variety of different hats having arbitrary outward configurations, for example, in the form of hockey pucks, stars, basketballs or other sporting related equipment that will be apparent to one of ordinary skill in the art from the foregoing description.

Figure 6:
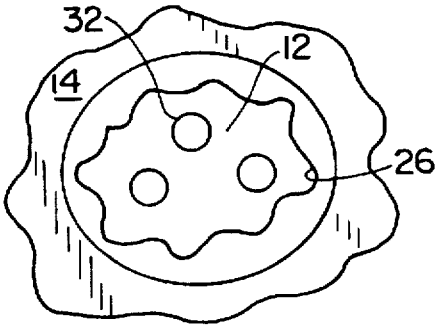
FIG. 6 is a fragmentary view of the underside of the hat of FIG. 1 showing the convolution of the inner surface of the cylinder such as permits the hat with varying pressure to accommodate different size heads.

Referring now to FIG. 6, the inner surface of the cylinder 26 normally contacting the user's head is pressed inward at its meridian causing a convolution of the material of the cylinder 26 such as provides channels of air when the cylinder is worn by a user. Further, the pressure provided against the user's head may be regulated and the degree of convolution affected by the amount of air placed within the hat 10. Accordingly, user's having different head sizes may readily adjust the effective opening by changing the air pressure within the hat 10.

The above description has been that of a preferred embodiment of present invention. It will occur to those that practice the art that many modifications may be made without departing from the spirit and scope of the invention. In order to apprise the public of the various embodiments that may fall within the scope of the invention, the following claims are made.

We claim:

1. An inflatable hat comprising:

first and second flexible plastic sheets;

the first flexible sheet having an outer periphery and an inner periphery formed by an aperture sized to receive the crown of an average human head;

the second flexible plastic sheet having an outer periphery;

a flexible upstanding side wall having upper and lower edges, said upper edge of said side wall being attached to said outer periphery of the second flexible sheet and said lower edge of said side wall being attached to said outer periphery of the first flexible sheet to position the first and second flexible sheets in opposition about an inner volume;

a tube of flexible material having a lower periphery and an upper periphery, said lower periphery of said tube being attached to said inner periphery of said first sheet and extending into the inner volume and attached at said upper periphery to an inner surface of the second flexible sheet.

2. The inflatable hat of claim 1 wherein the first and second flexible plastic sheets are shaped like sectors of circles.

3. The inflatable hat of claim 1 wherein the tube is constructed of a textured vinyl.

* * * * *